US007805877B2

(12) United States Patent
McCarty

(10) Patent No.: US 7,805,877 B2
(45) Date of Patent: Oct. 5, 2010

(54) INERTIA DRIVEN EYE PROTECTION FOR A SCOPE

(75) Inventor: John Paul McCarty, Greeley, CO (US)

(73) Assignee: Burris Corporation, Greeley, CO (US)

( * ) Notice: Subject to any disclaimer, the term of this patent is extended or adjusted under 35 U.S.C. 154(b) by 594 days.

(21) Appl. No.: 11/834,482

(22) Filed: Aug. 6, 2007

(65) Prior Publication Data

US 2009/0038203 A1 Feb. 12, 2009

(51) Int. Cl.
*F41G 1/38* (2006.01)

(52) U.S. Cl. ..... 42/125; 42/119; 42/129; 359/600

(58) Field of Classification Search ..... 42/119, 42/125, 129; 359/600
See application file for complete search history.

(56) References Cited

U.S. PATENT DOCUMENTS

| | | | | |
|---|---|---|---|---|
| 722,910 | A | 3/1903 | Saegmuller | |
| 2,381,101 | A | 8/1945 | Bausch | |
| 3,153,856 | A | 10/1964 | Felix | |
| 3,183,594 | A | 5/1965 | Panunzi | |
| 3,315,362 | A | 4/1967 | Palmer | |
| 3,390,931 | A * | 7/1968 | Luning et al. | 359/600 |
| 3,594,061 | A * | 7/1971 | Selvage | 359/600 |
| 3,597,040 | A * | 8/1971 | Gotoh | 359/424 |
| 3,669,523 | A | 6/1972 | Edwards | |
| D234,539 | S | 3/1975 | Marchetti | |
| D234,540 | S | 3/1975 | Marchetti | |
| 4,264,123 | A | 4/1981 | Mabie | |
| 4,295,289 | A * | 10/1981 | Snyder | 42/114 |
| 4,523,818 | A | 6/1985 | Lang et al. | |
| 4,630,903 | A | 12/1986 | Jones | |
| 5,200,852 | A * | 4/1993 | Gehmann | 359/399 |
| 5,408,359 | A | 4/1995 | Ferrett et al. | |
| 5,506,727 | A | 4/1996 | Douglas et al. | |
| 5,784,207 | A | 7/1998 | Satoh | |
| 6,488,381 | B2 * | 12/2002 | Morgan, III | 359/611 |
| 6,580,555 | B2 | 6/2003 | Crista | |
| 6,598,332 | B1 * | 7/2003 | Jibiki | 42/119 |

(Continued)

OTHER PUBLICATIONS

"Progress and Innovation From a Historical Point of View", History—Swarovski Optik, [online], [retrieved on Apr. 6, 2010], retrieved from http://www.swarovskioptik.us/en_us/history, 2 pages.

(Continued)

*Primary Examiner*—Michael Carone
*Assistant Examiner*—Michael D David
(74) *Attorney, Agent, or Firm*—Merchant & Gould P.C.

(57) ABSTRACT

An eyepiece of a firearm scope includes a spring positioned between a shock mount and an ocular lens, wherein the spring holds the ocular lens a predetermined position from an objective lens of the scope when the spring is in an uncompressed state. During recoil of the firearm, the spring compresses to allow the ocular lens to travel towards the objective lens, thereby increasing an effective eye clearance distance between the ocular lens and a shooter. Following recoil, the spring expands to return the ocular lens to the predetermined position. The spring compresses again during impact of the eyepiece with the shooter's face, thereby partially absorbing the force of the impact and reducing the chance of injury to the shooter.

7 Claims, 6 Drawing Sheets

U.S. PATENT DOCUMENTS

| | | | | |
|---|---|---|---|---|
| 6,640,481 | B1 * | 11/2003 | Williams, Jr. | 42/126 |
| 6,721,095 | B2 | 4/2004 | Huber | |
| 7,125,126 | B2 | 10/2006 | Yamamoto | |
| 2002/0089752 | A1 | 7/2002 | Morgan, III | |
| 2005/0200959 | A1 | 9/2005 | Yamamoto | |
| 2006/0098307 | A1 | 5/2006 | Campean | |

OTHER PUBLICATIONS http://www.swarovskioptik.com/index.php?c=produkte&l=en &nID=x434b76b737c887.28186349&css=&produktvorteile=1 &detail=en1129119913_ID434d00a9ed80e0.13387085 &produktname=Habicht%20PF%20/%20PF-N &active=Bedienbarkeit# (published prior to Oct. 25, 2006).

* cited by examiner

INERTIA DRIVEN EYE PROTECTION FOR A SCOPE

TECHNICAL FIELD

The invention relates generally to optical devices such as rifle scopes and, more particularly, to eye protection for such devices.

BACKGROUND

A firearm scope typically includes a series of lenses which produce an image of a target object inside the scope at multiple locations or "focal planes" within the scope. These lenses are positioned very precisely within a tubular structure that mounts atop a firearm. Scopes typically include a sighting aid which can be as simple as a cross hair reticle having two intersecting fibers mounted within a ring that is placed on a longitudinal axis of the tube. The cross hairs are located on one of the focal planes formed by the lenses so as to be superimposed on an image of the target.

A shooter looks through one or more ocular lenses within an eyepiece at the rear of the scope, and it is this eyepiece that focuses and magnifies the final image for the shooter. Specifically, the position of the eyepiece or ocular lens system is typically adjustable within the rear of the scope to allow a shooter to correct the focus to conform to the shooter's own vision shortcoming, be it myopia or hyperopia (nearsightedness or farsightedness, respectively). The focus adjustment is commonly referred to as a diopter adjustment, since myopia is measured in "diopters."

The rearmost portion of this adjustable ocular lens mount is frequently cushioned and commonly referred to as an "eyecup." However, unlike other optical systems (e.g., telescopes or binoculars), a firearm scope should not be placed directly against a shooter's eye due to the risk of injury resulting from recoil. Therefore, firearm scope optics are designed such that a user's eye must be positioned within a focal plane approximately 3 to 5 inches rearward of the last ocular lens within the scope. This rearmost focal plane typically provides a shooter about 0.5 to 1.0 inches of latitude to move fore and aft while still maintaining a full field of view.

The distance from the rearmost ocular lens within the eyepiece and the shooter's eyeball is typically referred to as "eye relief." FIG. 1 graphically illustrates this distance by the arrow 20 labeled "Eye Relief." As noted above and described in greater detail below, an eye relief of several inches is necessary to provide a buffer against the recoil associated with shooting a firearm. Firearm scopes are designed to balance a variety of competing interests, including eye relief, magnification, and field of view (observable area). In fact, there is a three-way tradeoff such that the field of view supplied by a given magnification is decreased as eye relief is increased. Similarly, for a given field of view, an increase in eye relief results in a decrease in magnification. Hunters often place a premium on both field of view and magnification, frequently at the expense of eye relief.

While "eye relief" represents the distance from the rear surface of the ocular lens to the shooter's eyeball, the clearance between the eyecup (i.e., the rearmost portion of the scope) and the shooter's face is referred to as "eye clearance." Eye clearance, then, is a function of eye relief though it is less rigidly defined and varies with the construction of the firearm scope and the stance a shooter uses to hold the firearm. FIG. 1 includes an arrow 22 graphically illustrating one example of "eye clearance" between an eyecup 24 and a portion of the shooter's face, although this dimension is not restricted to any specific area of the face and will vary with facial structure and positioning. Thus, eye clearance can be thought of as the shortest distance from the eyecup to that part of the shooter's face that is first struck if the scope moves far enough rearward during recoil.

Given the competing requirements noted above, firearm scope designs are a compromise that yield less than ideal eye clearance in some situations. Consequently, a recurrent problem experienced by firearm scope users is an injury to the eye area induced by impact of the eyecup with the shooter's face during recoil. Additionally, sufficient eye clearance obtained when a shooter holds the firearm comfortably with the head in a natural position may not be enough when a shot is taken while aiming uphill or on uneven ground. Furthermore, even experienced shooters may suffer an injury when the recoil from an unfamiliar gun is greater than anticipated. Indeed, the current trend toward more powerful firearms and cartridges has increased the incidence of bodily injury and thus there is a need for more eye clearance than current designs allow.

Some firearm scopes utilize cushion devices or elastomeric bellows attached to the eyecup to cushion a potential impact between the scope and a shooter's face. However, a common failing of such existing devices is that they add length to the rear end of the scope, thereby reducing eye clearance and placing the shooter's face closer to the eyecup which causes injury. That is, the addition of a cushioning device to the eyecup of a scope does not alter the "eye relief" (i.e., the distance to the ocular lens) but rather shortens the "clearance" distance between the shooter and the scope. FIG. 1 illustrates this problem by showing a relatively shorter clearance distance 30 between the shooter's face and a protective bellows 32 shown in phantom. Therefore, prior art cushioning solutions compel the shooter to place the scope near enough the eye to be of concern, particularly on high recoil guns.

Thus, there is a need to provide protection to firearm users without reducing the eye clearance provided by a scope.

SUMMARY OF THE INVENTION

Embodiments of the present disclosure relate to a firearm scope having an ocular lens that retracts under recoil of a firearm. In effect, the retraction of the ocular lens shortens the length of the scope and temporarily increases eye clearance during recoil, thereby reducing the likelihood that the scope will come into contact with a shooter's face during recoil of the firearm. The retractable ocular lens has a secondary benefit of cushioning impact should the scope make contact with the face.

Another embodiment of the present disclosure is an eyepiece apparatus for use with existing scopes. The eyepiece includes a shock mount and a spring-biased ocular lens system that retracts due to recoil of a firearm, thereby effectively increasing eye clearance during the peak recoil acceleration. The spring-biased ocular lens system is also capable of retraction upon contact with the shooter's face to cushion any impact if the shooter is unable to handle the rearward momentum of a firearm.

Yet another aspect of the present disclosure relates to a method for retracting the ocular lens of a scope during recoil of a firearm or upon impact of the ocular lens with the face of a shooter following recoil.

This summary is provided to introduce a selection of concepts in a simplified form that are further described below in the Detailed Description. This Summary is not intended to identify key or essential features of the claimed subject matter, nor is it intended to be used in any way as to limit the scope of the claimed subject matter.

BRIEF DESCRIPTION OF THE DRAWINGS

Non-limiting and non-exhaustive embodiments are described with reference to the following figures.

DETAILED DESCRIPTION

Figure 1:
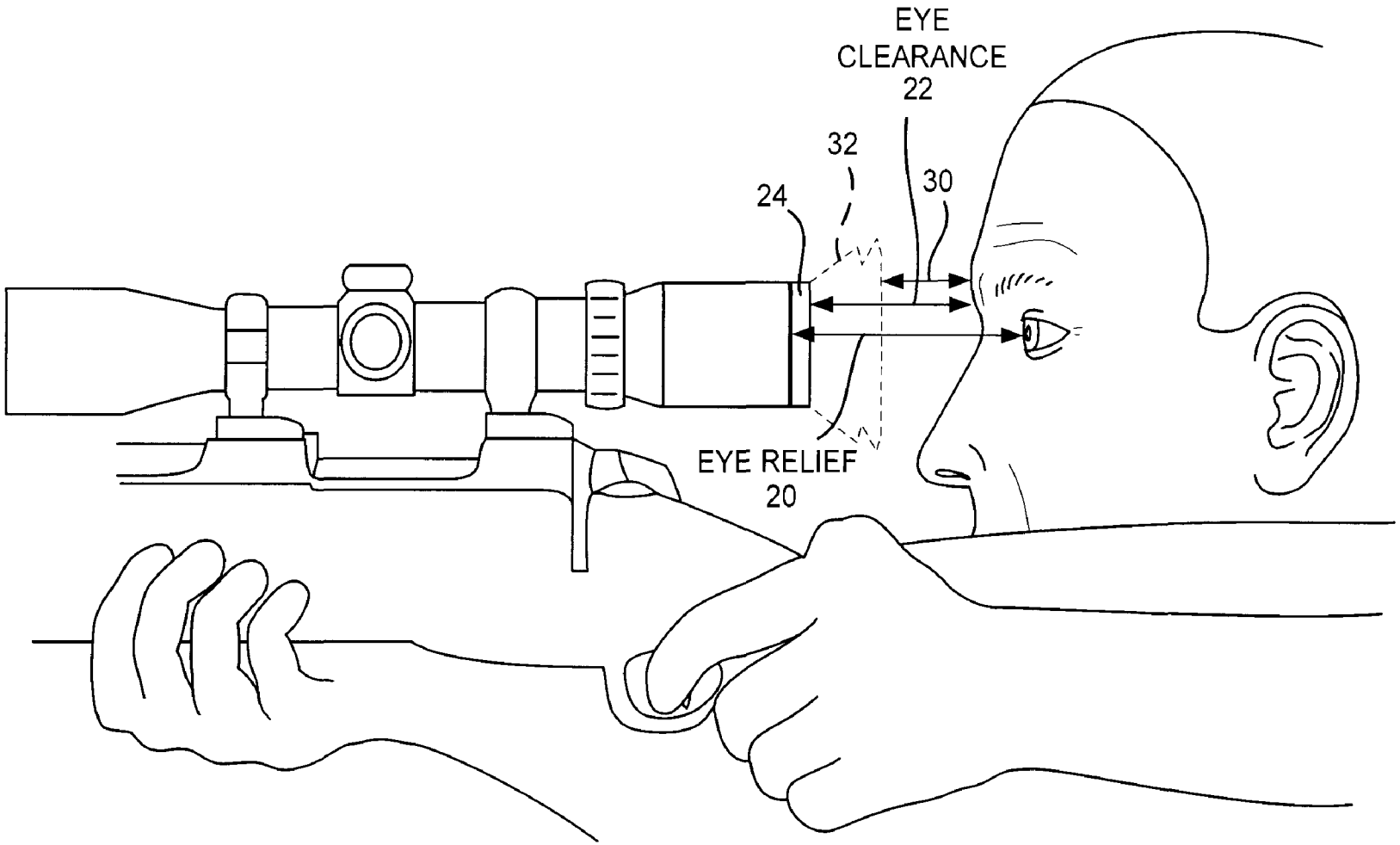
FIG. 1 is an illustration of a prior art embodiment of a scope with a protective eyepiece, wherein the scope is mounted on a rifle and held by a shooter to illustrate "clearance" and "relief" distances between the scope and the shooter, and wherein a prior art protective eyecup is shown in phantom.

This disclosure will now more fully describe exemplary embodiments with reference to the accompanying drawings, in which specific embodiments are shown. Other aspects may, however, be embodied in many different forms and the inclusion of specific embodiments in the disclosure should not be construed as limiting such aspects to the embodiments set forth herein. Rather, the embodiments depicted in the drawings are included to provide a disclosure that is thorough and complete and which fully conveys the intended scope to those skilled in the art. When referring to the figures, like structures and elements shown throughout are indicated with like reference numerals.

An optical firearm scope consists of a series of lenses mounted on a tubular structure. An objective lens system is located at the forward (or target) end of the scope, and an ocular lens system is located at the rear end of the scope. Both the objective lens system and the ocular lens system may consist of either a single lens or a series of lenses.

The objective lens system collects light from an object being viewed and creates an inverted image at a front focal plane located within the tubular structure rearward of the objective lens system. The image projected at the front focal plane passes through an erector lens system located within the tubular structure. The erector lens system inverts the image and projects the image at a rear focal plane located within the tubular structure (i.e., rearward of the front focal plane). In embodiments, a sighting aid is located on either the front focal plane or the rear focal plane so that the sighting aid is superimposed on the image viewed through the scope. The sighting aid may be a cross hair reticle which consists of two intersecting fibers mounted within a ring that is placed on the longitudinal axis of the tubular structure. In other embodiments, the sighting aid may consist of any other sighting devices known in the art.

In one embodiment, the ocular lens system is positioned a fixed distance from the rear focal plane. Alternatively, the ocular lens system is adjustable over a small range to provide adjustments for a user's vision (e.g., myopia or hyperopia). The ocular lens system further magnifies the image projected at the rear focal plane and projects the image rearward of the scope to create a viewing envelope. This viewing envelope is referred to as the eye relief range. The shooter must be in a position such that the shooter's eye is located within the eye relief range to properly view the image projected by the scope.

The user of a firearm faces a risk of injury upon discharge of the firearm. The injury results from the impact of the firearm with the shooter's body during recoil. A firearm may be a handgun, a rifle, a military assault rifle, a sporting shotgun, a tactical shotgun, or any device that fires either single or multiple projectiles. This risk involved to the shooter results from the recoil produced by the discharge causing the firearm to move rearward towards the shooter. Depending on the strength of the firearm, the force of the recoil may be great and result in a severe injury. This risk is further amplified when the shooter uses a scope. If the recoil of the discharged firearm travels further than the eye clearance of the scope, the scope eyepiece will impact the shooters face, possibly resulting in injury to the shooter. Such injury can be avoided or minimized by increasing eye clearance.

Figure 2:
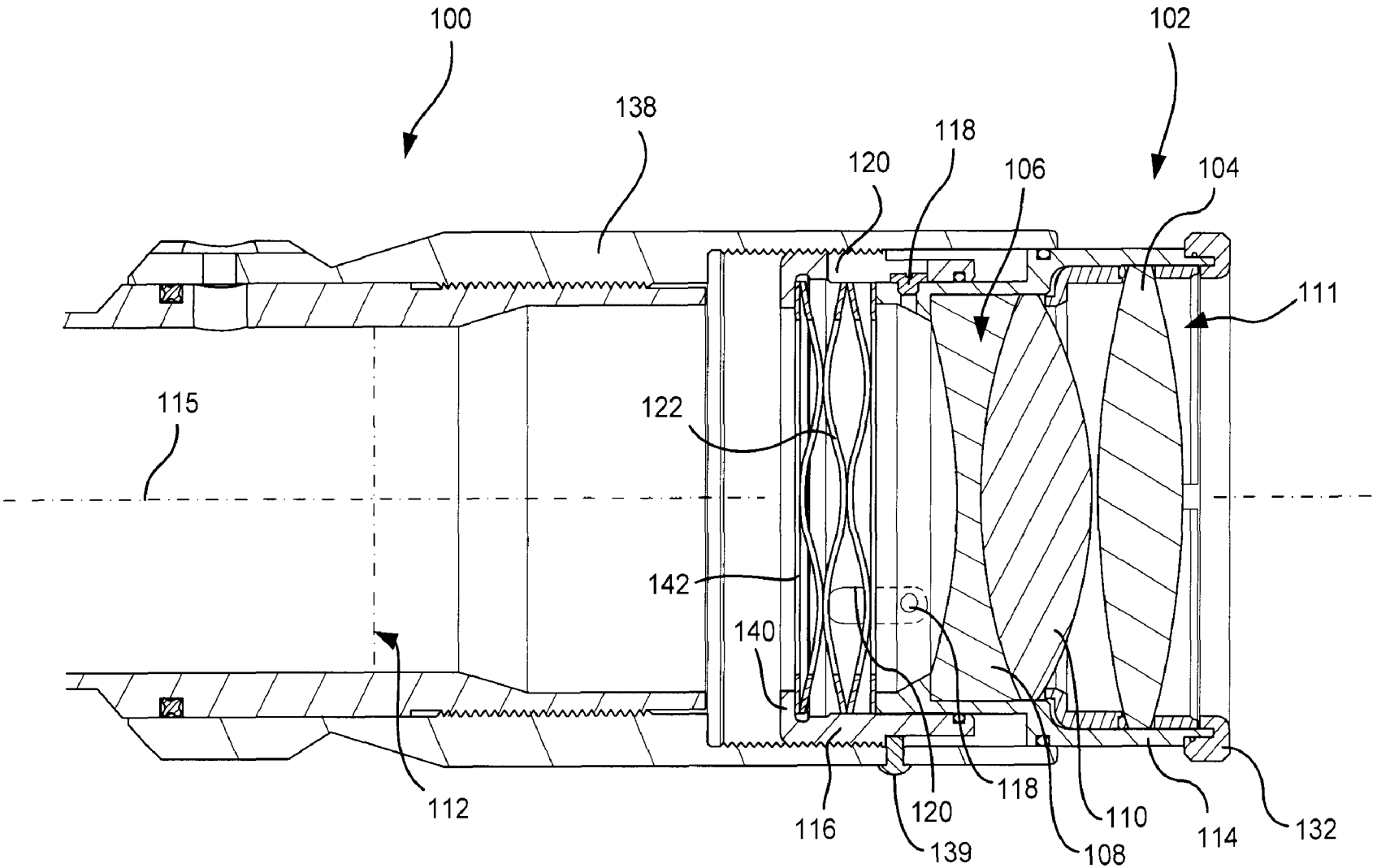
FIG. 2 is a section view of an embodiment of a scope with an inertia driven eyepiece according to the present invention at a default position.

FIG. 2 is an embodiment of a scope 100 with an inertia driven eyepiece 102 according to the present invention. Eyepiece 102 preferably includes ocular lens 104, field lens 106 and elastomeric cushion ring 132, all of which are fixedly secured in a lens mount 114. In one embodiment, field lens 106 includes a first field lens element 108 and a second field lens element 110, as shown in FIG. 2. Although field lens 106 is illustrated as a doublet, i.e., a lens consisting of two elements bonded together, in other embodiments the field lens may consist of a single lens or multiple lenses that may or may not be bonded together. The ocular lens 104 and field lens 106 are hereafter referred to as the ocular lens system 111. Additionally, the eyepiece 102 shown in FIG. 2 preferably includes an elastomeric cushion ring 132 that provides a soft, cushioned surface to lessen the severity of any impact between the scope 100 and the shooter's face.

Ocular lens system 111 magnifies the image created at a rear focal plane (e.g., the rear focal plane 112 shown in phantom in FIG. 2) and transfers the image rearward of the scope to create the above-described viewing envelope or "eye relief range." The shooter must place his eye within this eye relief range in order to properly view images through the scope 100. In the default position shown in FIG. 2, the ocular lens system 111 is positioned a predetermined distance from the rear focal plane 112 (as well as a predetermined distance from the fixed objective lens which is not shown in FIG. 2).

As described in greater detail below, the present invention provides for relative movement of the ocular lens system 111 (i.e., forward movement toward the focal plane 112) during recoil of a firearm in order to effectively increase the eye clearance dimension described above. In particular, as the firearm and attached scope accelerate rearward during recoil, the ocular lens system 111 (and cushion ring 132 in FIG. 2) are driven forward by their inertia so as to provide additional clearance between the end of the eyepiece 102 and the user's face. The ocular lens system 111 is preferably spring-biased to return to the default position shown in FIG. 2 immediately after the shooter has countered the recoil of the firearm. That is, as the shooter braces the firearm against the force of the recoil, the spring biased ocular lens system 111 overcomes the force of the scope's diminishing rearward acceleration and returns the lens system 111 to its default position so that the shooter may properly sight through the scope for another shot.

Figure 3:
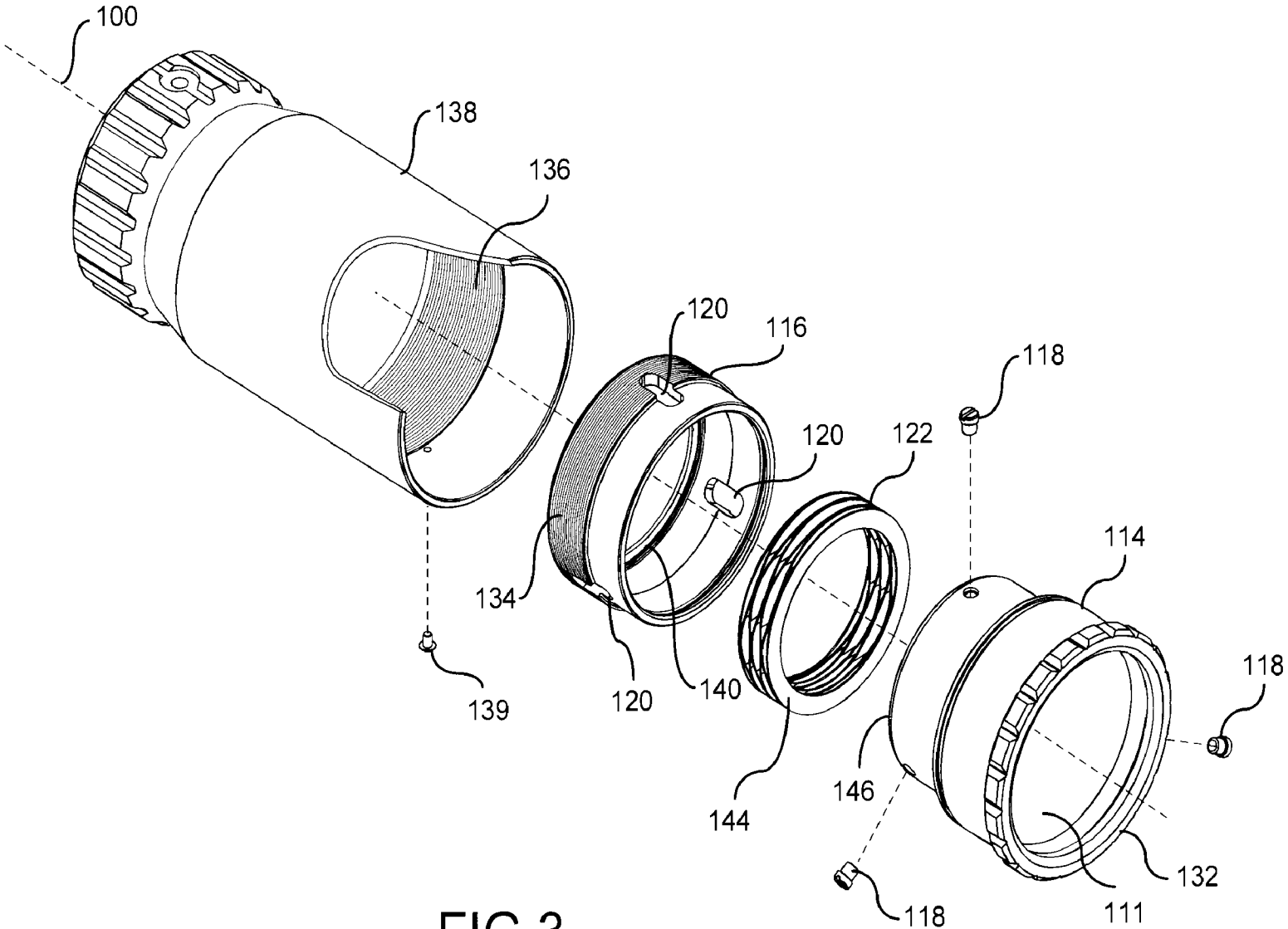
FIG. 3 is an exploded view of the embodiment of the inertia driven eyepiece shown in FIG. 2.

In order to provide the above-described relative movement, the ocular lens system 111 is preferably fixed within a cylindrical lens mount 114 (as best shown in FIG. 3) that is capable of moving along a longitudinal axis 115 of the scope 100. In one embodiment, the cylindrical lens mount 114 fits within a cylindrical shock mount 116, as shown in FIGS. 2 and 3. Specifically, an outer diameter of the lens mount 114 is slightly smaller than an inner diameter of the cylindrical shock mount 116 to allow for sliding movement of the lens mount with respect to the shock mount 116. Of course, this preferred embodiment does not limit the invention and alternative embodiments (such as the shock mount sliding within the lens mount) may be utilized by those skilled in the art. In one preferred embodiment, the range of sliding motion of the ocular lens mount 114 is constrained by one or more retention screws 118 which are attached to the outer cylindrical surface of the lens mount 114 (as shown in FIG. 3). Each retention screw 118 is adapted to move within a guide slot 120 formed within the cylindrical surface of the shock mount 116 (as best shown in FIG. 2). The retention screws 118 and guide slots 120 allow for limited movement of the ocular lens mount 114 along the longitudinal axis 115 of the scope 100 (e.g., during recoil or impact).

A spring 122 is positioned between the shock mount 116 and the lens mount 114 in order to maintain the ocular lens mount 114 (and the attached ocular lens system 111) in a proper position for sighting through the scope 100. As best shown in FIG. 3, a forward end of the cylindrical shock mount 116 preferably includes an annular flange or spring seat 140 for supporting the spring 122. Specifically, the flange 140 engages an annular surface 142 (FIG. 2) at a forward end of the spring 122. Similarly, a rear annular surface 144 of the spring 122 (FIG. 3) preferably engages an annular edge 146 at the forward end of the cylindrical lens mount 114. In the uncompressed state shown in FIG. 2, the spring 122 properly positions the lens mount 114 and the attached ocular lens system 111 relative to the shock mount 116 which dictates the distance to the rear focal plane 112 to provide for proper sighting as determined by the remaining scope optics. However, as described in greater detail below, compression of the spring 122 during recoil provides an increase in the effective eye clearance between the rear end of the lens mount 114 and the shooter's face.

The spring 122 is illustrated as an annular spring in FIGS. 2-3. However, in other embodiments, spring 122 may be a helical/coil spring, a volute spring, a gas spring, or any other type of compression spring that shortens when loaded. Regardless of the type of spring used, the spring 122 (along with the shock mount 116 and lens mount 114) is preferably annular or cylindrical in shape to allow light from the objective lens to pass substantially unobstructed through the spring to the ocular lens system 111.

In the preferred embodiment shown in FIGS. 2-3, the adjustable shock mount 116 comprises three guide slots 120, while the ocular lens mount 114 includes three retention screws 118. As described in greater detail below, this three-point retention system maintains rotational alignment of the optical elements about an axis perpendicular to the longitudinal axis 115 of the scope 100. However, one of skill in the art will recognize that ocular lens mount 114 may be connected to shock mount 116 using fewer or more than three connective screws 118 or by means other than the screw and slot combination shown in FIGS. 2 and 3.

Figure 4:
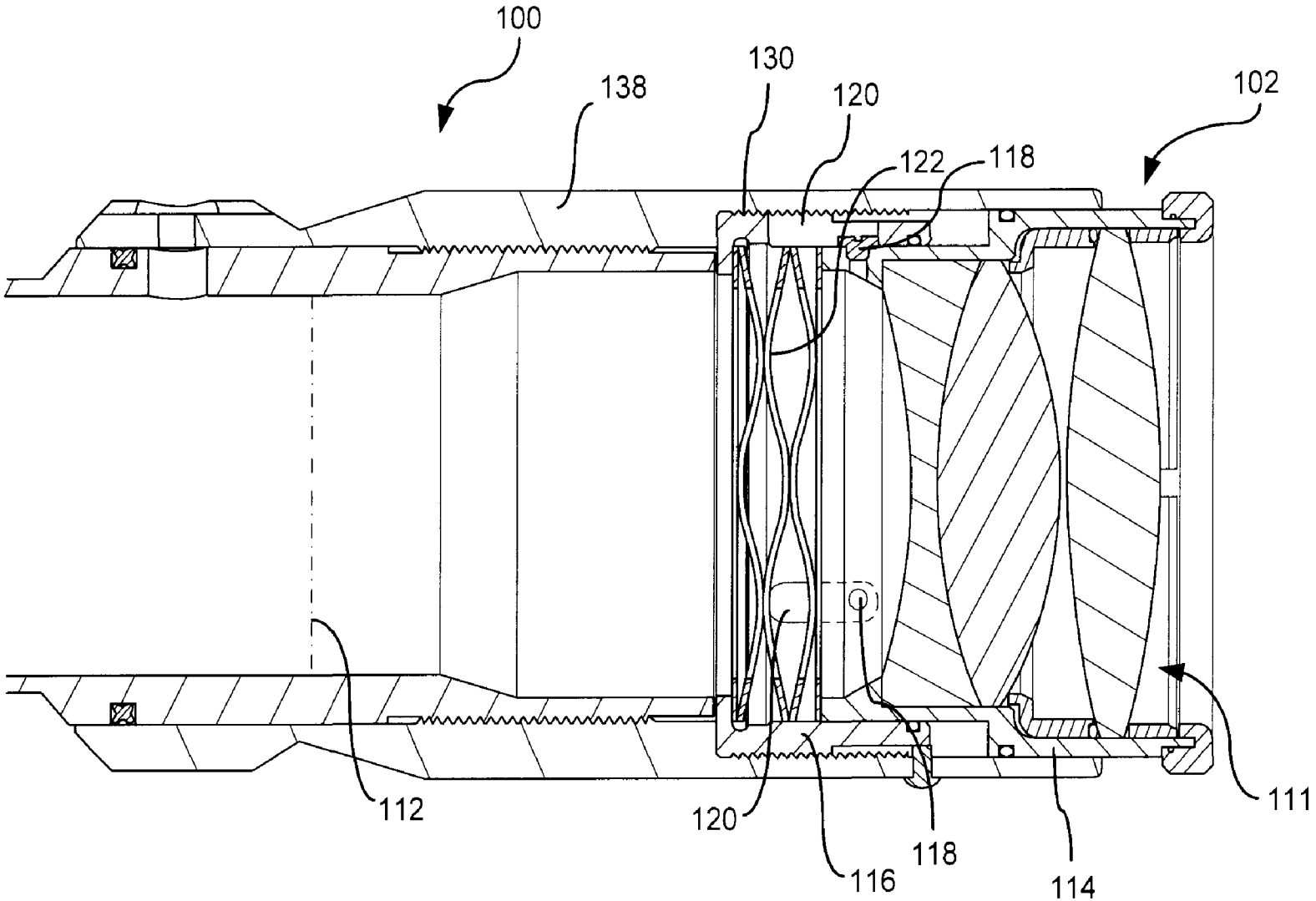
FIG. 4 is an illustration of the embodiment of the scope and inertia driven eyepiece shown in FIG. 2, wherein a shock mount and ocular lens system have been moved forward to illustrate a diopter adjustment.

FIG. 4 illustrates a diopter adjustment of the inertial driven eyepiece 102 shown in FIGS. 2 and 3. Specifically, in a preferred embodiment, a forward portion of the cylindrical adjustable shock mount 116 includes exterior threads 134 (FIG. 3) that engage interior threads 136 within a tubular ocular mount shell 138 of the scope 100. The mating threads 134 and 136 allow for limited movement of the shock mount 116 along the longitudinal axis 115 as the shock mount 116 is rotated. Rearward movement of the shock mount 116 is limited by a shock mount retention screw 139.

As described above, the retention screws 118 attached to the lens mount 114 provide longitudinal movement along the slots 120 formed in shock mount 116 while simultaneously transferring rotational motion of the lens mount 114 to the shock mount 116. Thus, due to the threaded connection of the shock mount 116 to the shell mount 138, rotation of the lens mount 114 drives the shock mount 116 in a longitudinal direction along a diopter track 130, as shown in FIG. 4. Thus, a shooter can rotate the entire eyepiece 102 in order to conform the focus of the eyepiece to the shooter's own vision shortcoming, be it myopia or hyperopia (nearsightedness or farsightedness, respectively). For example, if the shooter is nearsighted, the shooter may adjust the eyepiece 102 forward (i.e., move the shock mount 116 along the diopter track 130) such that the ocular lens system 111 is located closer to the focal plane 112, as illustrated in FIG. 4. Alternatively, for hyperopic (farsighted) shooters, the shock mount 116 may be moved rearward or farther from the focal plane 112, as illustrated by FIG. 2. That is, in comparison to FIG. 4, the adjustable shock mount 116 in FIG. 2 has traveled to the right along the diopter track 130 such that the ocular lens system 111 is farther from focal plane 112. A user may rotate the eyepiece 102 to any intermediate position along the diopter track 130 such that the image projected by the scope conforms to the shooter's vision. The full range of diopter adjustment is illustrated by comparing FIGS. 2 and 4.

The spring 122 moves together with the adjustable shock mount 116 and the lens mount 114 so that diopter adjustment does not increase or decrease the load experienced by the spring 122. Furthermore, it should be understood that once the diopter adjustment has been made to conform to the shooter's eyesight, the uncompressed spring 122 maintains a constant distance between the ocular lens system 111 and the rear focal plane 112. This ensures that the image projected by the scope 100 remains clear. It should further be understood that the diopter adjustment has no effect on eye relief. Although the overall length of the scope may increase or decrease depending upon the type and amount of diopter adjustment applied, the "eye relief" or distance the shooter must position his eyeball from the ocular lens system 111 remains the same. Because eye clearance is a function of eye relief, the eye clearance also necessarily remains constant regardless of the diopter adjustment set by a shooter.

Figure 5:
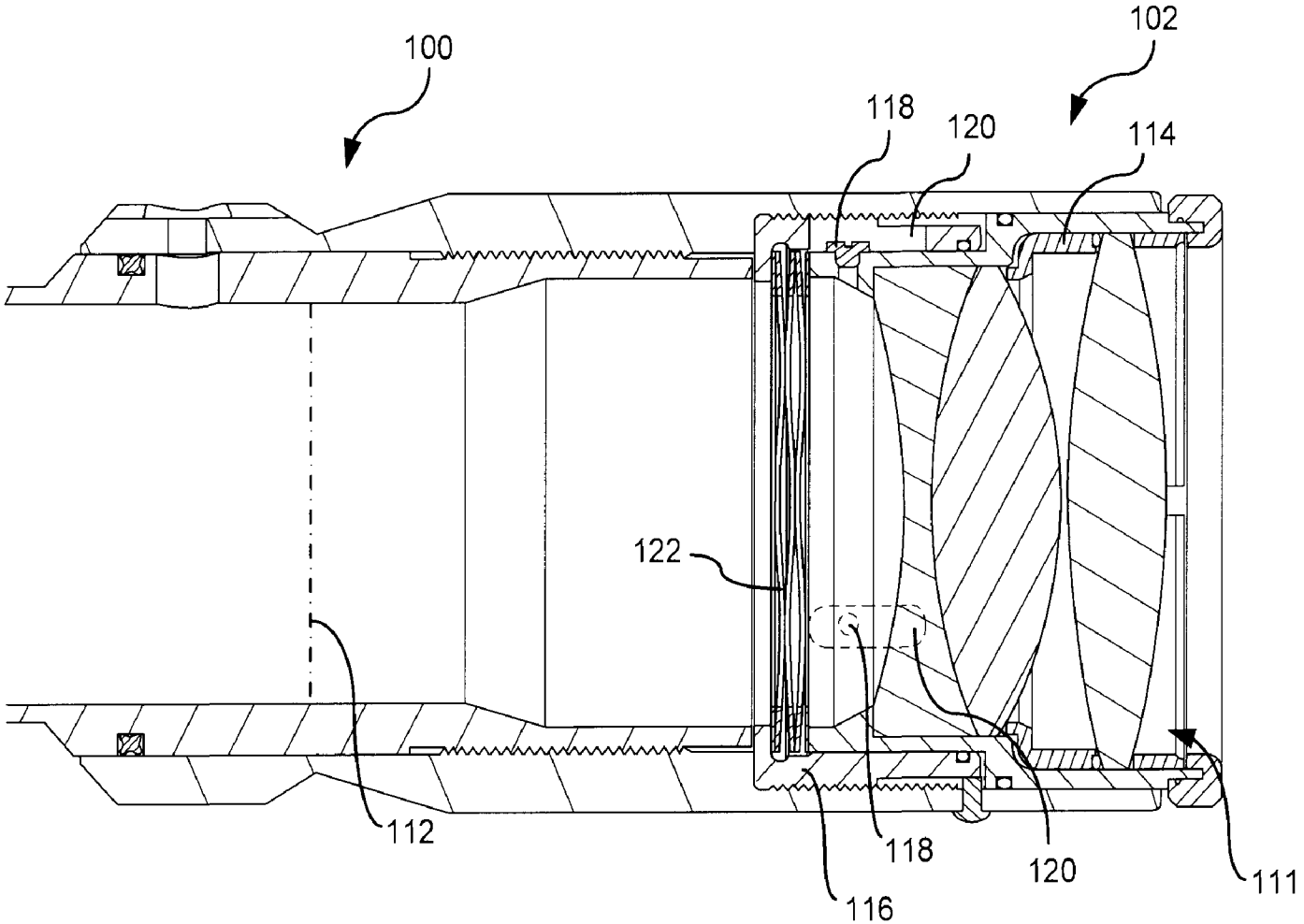
FIG. 5 is an illustration of the embodiment of the scope and inertia driven eyepiece shown in FIG. 4, wherein the ocular lens system has been moved further forward upon compression of a spring (such as during recoil of a firearm).

FIG. 5 illustrates compression of the spring 122 and relative movement of the lens mount 114 and ocular lens system 111 during recoil of a firearm. In particular, as the scope 100 travels rearward toward the shooter (i.e., to the right in FIG. 5) during recoil of a firearm, the inertia of the lens mount 114 causes the spring 122 to compress so that the lens mount 114 is effectively driven forward or "into" the shock mount 116 (i.e., to the left in FIG. 5). Specifically, as the spring 122 compresses, the lens mount retention screws 118 travel forward along their respective guide slots 120, thereby allowing the lens mount 114 and ocular lens system 111 to move into the scope 100 and decrease the overall length of the scope. Unlike changes in length due to diopter adjustment, this decrease has the effect of increasing eye clearance during recoil. That is, while the recoiling scope travels rearward towards the shooters face, the lens mount 114 simultaneously moves into the scope housing (i.e., into the cylindrical shock mount 116), thereby increasing the effective eye clearance in relation to a conventional scope. This effective increase in eye clearance helps to offset the rearward movement of the scope during recoil of the firearm, thus making it less likely that the eyepiece 102 of the scope 100 will impact the shooter's face.

As illustrated in FIG. 5, the ocular lens system 111 moves forward toward the focal plane 112. In one embodiment, the amount of travel is equal to the stroke of the spring 122 and measures approximately 0.25 inches. However, those skilled in the art may utilize springs allowing a greater or smaller amount of travel. At the point shown in FIG. 5, the scope 100 will not project a suitable image for targeting because the ocular lens system 111 is not properly positioned with respect to the rear focal plane 112. Thus, in order for the shooter to use the scope again, the ocular lens system 111 must return to the default position, as illustrated in FIG. 4 (i.e., the compressed spring 122 must overcome the inertial force of the lens mount 114 and expand to its default size).

Optimally, the shooter will counter the force of the firearm recoil before the rearward movement of the scope 100 consumes all of the available "eye clearance" and impacts the shooter's face. That is, the size and tension of the spring 122 is preferably selected so that the spring remains compressed during the critical phase of the firearm recoil (as described in greater detail below with respect to FIGS. 6-8). Once the rearward acceleration of the scope has ceased, the spring 122 returns to its normal shape and again moves the lens mount 114 rearward to its default position. However, while the acceleration of the scope toward the shooter may have subsided, the firearm may still possess substantial rearward momentum and, if the shooter cannot properly brace the firearm to counteract this momentum, it is still possible that the scope will impact the shooter's face. In this instance, the inertia driven eyepiece 102 provides an additional benefit in that the spring 122 may again compress to cushion the impact between the eyepiece 102 and the shooter's face.

Figure 6:
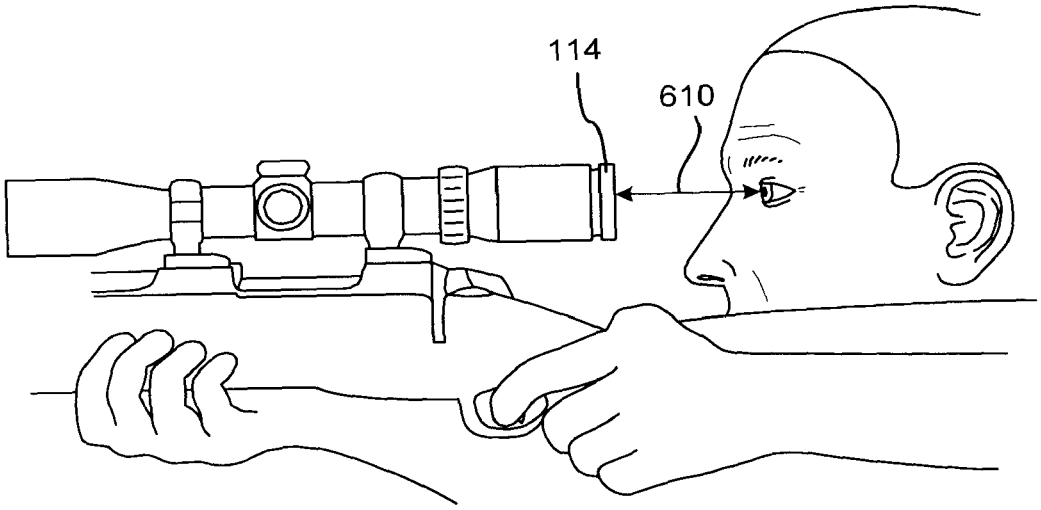
FIGS. 6-8 illustrate a sequence of compressing the spring to retract the ocular lens system of a scope during recoil of a firearm, and then returning the ocular lens system to a default position.
Figure 7:
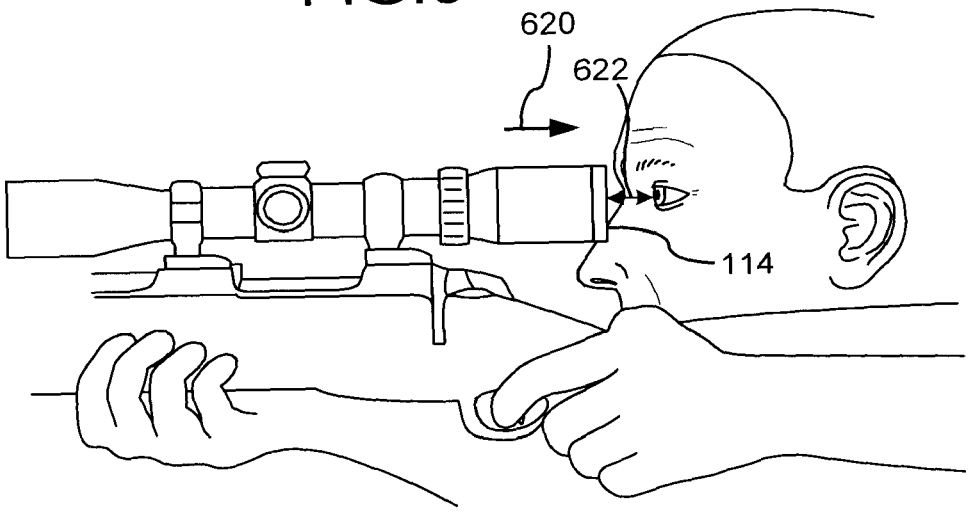
Figure 8:
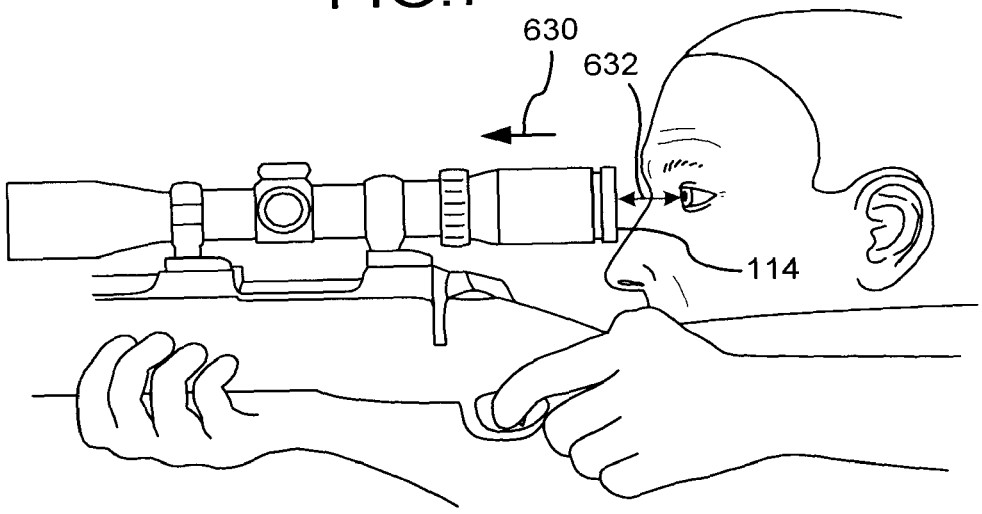

FIGS. 6-8 further illustrate the sequence of moving the ocular lens mount 114 forward (with compression of the spring 122) during recoil, and then returning the ocular lens system 111 to its default position as the spring 122 overcomes the inertia of the lens mount 114. In particular, FIG. 6 illustrates the default position of the lens mount 114 as a shooter sights through the scope 100 and lines up a shot. At this point, the lens mount 114 extends to the rear of the scope due to the uncompressed state of the spring 122, and a nominal eye clearance (e.g., four inches) between the ocular lens system 111 and the shooter's face is illustrated by arrow 610.

FIG. 7 illustrates the relative motion of the scope 100 and the lens mount 114 at a point in time immediately after the firearm has discharged and the scope 100 is recoiling rearwards towards the shooter's face (i.e., as the scope is consuming the initial eye clearance). The rearward movement of the scope is illustrated by arrow 620. As described above, the force of the recoil and the inertia of the lens mount 114 places a load on spring 122 causing it to compress. As a result, the lens mount 114 travels forward into the scope 100, thereby causing an increase in effective eye clearance to partially counteract the decrease in eye clearance due to recoil. In the example shown in FIG. 7, the scope has moved rearward three inches at the same time that the lens mount 114 has fully moved within the shock mount 116 (i.e., at the point of maximum compression of the spring 122, as shown in FIG. 5). In one embodiment where the total spring travel is 0.25 inches, the effective eye clearance at the point shown in FIG. 7 has increased from 1.0 inches to 1.25 inches, as shown by arrow 622. Of course, the present invention is not limited to any particular relief distance or spring travel, and those skilled in the art may utilize a different spring 122 and lens mount 114 to provide for greater or smaller amounts of travel.

FIG. 8 illustrates the return of the lens mount 114 (i.e., the expansion of the spring 122) at a point after the shooter has effectively countered the recoil and is returning the firearm and scope 100 to the proper sighting position shown in FIG. 6. At the point shown in FIG. 8, the shooter is moving the scope forward again (as illustrated by arrow 630) and the spring 122 has returned the ocular lens mount 114 to its default position. For example, if the shooter has moved the scope forward one inch in comparison to the position of the scope shown in FIG. 7, and the lens mount 114 has returned to its default position (e.g., 0.25 inches to the rear of the shock mount), the eye clearance distance in FIG. 8 is approximately 1.75 inches, as illustrated by arrow 632. Because the ocular lens system 111 has returned to its default position relative to the rear focal plane 112, the scope will again display a focused image (i.e., the shooter will be free to line up a second shot) once the shooter positions his eye within the above-described eye relief range.

In the event that the shooter in FIGS. 6-8 is unable to counter the inertia of the firearm and scope prior to impact with his or her face, it is likely that the spring 116 would still expand (i.e., overcome the initial rearward acceleration) prior to impact. In this instance, the spring 122 would again compress upon impact with the shooter, thereby absorbing some of the impact force and reducing the possibility or severity of injury to the shooter.

Although the embodiments have been described in language specific to structural features, methodological acts, and apparatuses containing performing acts, it is to be understood that the possible embodiments, as defined in the appended claims, are not necessarily limited to the specific structure, acts, or apparatus described. For example, the entire eyepiece 102 may be fixed within a larger component of the scope that provides for diopter adjustments. Alternatively, the eyepiece may be utilized with a scope that does not provide for diopter adjustment. In these instances, it is not necessary to provide for rotational connection between the lens mount 114 and the shock mount 116. One skilled in the art will recognize other embodiments or improvements that are within the scope and spirit of the present invention. Therefore, the specific structure, acts, or apparatuses are disclosed only as illustrative embodiments. The invention is defined by the appended claims.

What is claimed is:

1. A firearm scope having a housing and an objective lens positioned within a forward end of the housing, the scope comprising: an ocular lens positioned at a rear end of the housing opposite the objective lens; a spring positioned between the objective lens and ocular lens within the housing, wherein the spring positions the ocular lens a predetermined distance from the objective lens when in an uncompressed state, and wherein compression of the spring during firearm recoil provides forward movement of the ocular lens toward the objective lens; and a lens mount for holding the ocular lens, wherein the lens mount engages a rear end of the spring and moves longitudinally within the housing.

2. The firearm scope of claim 1 further comprising a shock mount attached to the housing, wherein the shock mount engages a forward end of the spring.

3. The firearm scope of claim 1, wherein:

the shock mount is substantially cylindrical in shape and defines an interior diameter; and the lens mount is substantially cylindrical in shape and defines an exterior diameter that is smaller than the interior diameter of the shock mount to allow for sliding movement of the lens mount within the shock mount.

4. The firearm scope of claim 3, wherein the cylindrical shock mount defines an annular flange that engages an annular surface on the forward end of the spring.

5. The firearm scope of claim 3, wherein the shock mount is threadedly engaged with the scope housing so that rotation of the shock mount causes movement of the shock mount along a longitudinal axis of the scope.

6. The firearm scope of claim 5 wherein:

the shock mount includes a plurality of guide slots extending in a direction of the longitudinal axis of the scope; and the lens mount includes a plurality of retention screws, each screw extending through a corresponding guide slot of the shock mount, wherein the retention screws are free to move in a longitudinal direction along the guide slots during compression of the spring, and wherein a rotational force applied to the lens mount is transferred to the shock mount by contact between the retention screws and the guide slots;

whereby a diopter adjustment is provided by rotating the lens mount which in turn rotates the threaded shock mount and changes the predetermined distance between the ocular lens and the objective lens.

7. The firearm scope of claim 1, wherein the spring further compresses upon impact between the ocular lens and a shooter.

* * * * *